US007842448B2

(12) United States Patent
Moriyama et al.

(10) Patent No.: US 7,842,448 B2
(45) Date of Patent: Nov. 30, 2010

(54) METHOD OF FORMING FIXED IMAGES

(75) Inventors: Shinji Moriyama, Wakayama (JP); Yoshihiro Fukushima, Wakayama (JP); Takashi Kubo, Wakayama (JP); Yutaka Kanamaru, Wakayama (JP); Eiji Shirai, Wakayama (JP)

(73) Assignee: Kao Corporation, Tokyo (JP)

( * ) Notice: Subject to any disclaimer, the term of this patent is extended or adjusted under 35 U.S.C. 154(b) by 1046 days.

(21) Appl. No.: 11/335,661

(22) Filed: Jan. 20, 2006

(65) Prior Publication Data

US 2006/0222995 A1 Oct. 5, 2006

(30) Foreign Application Priority Data

Mar. 14, 2005 (JP) ..... 2005-071808

(51) Int. Cl.
*G03G 15/09* (2006.01)

(52) U.S. Cl. ..... 430/122.1; 430/124.1; 430/111.31

(58) Field of Classification Search ..... 430/111.31, 430/122.1, 124.1
See application file for complete search history.

(56) References Cited

U.S. PATENT DOCUMENTS

| | | | | |
|---|---|---|---|---|
| 4,385,107 | A * | 5/1983 | Tanaka et al. | 430/124.23 |
| 5,630,201 | A | 5/1997 | Suzuki et al. | |
| 6,383,705 | B2 | 5/2002 | Aoki et al. | |
| 6,998,212 | B2 | 2/2006 | Shirai et al. | |
| 2001/0018157 | A1 * | 8/2001 | Aoki et al. | 430/109.4 |
| 2003/0022087 | A1 * | 1/2003 | Tachi et al. | 430/108.7 |
| 2004/0023141 | A1 * | 2/2004 | Shirai et al. | 430/109.3 |
| 2004/0096764 | A1 * | 5/2004 | Nagai et al. | 430/108.1 |
| 2004/0152003 | A1 * | 8/2004 | Sato et al. | 430/108.4 |
| 2004/0152813 | A1 * | 8/2004 | Shirai | 524/275 |
| 2005/0042534 | A1 * | 2/2005 | Tanaka et al. | 430/108.4 |
| 2005/0214670 | A1 * | 9/2005 | Matsumoto et al. | 430/109.4 |

FOREIGN PATENT DOCUMENTS

| | | |
|---|---|---|
| JP | 55-127569 | 10/1980 |
| JP | 8-286503 | 11/1996 |
| JP | 2001-222138 | 8/2001 |
| JP | 2004-61875 | 2/2004 |

* cited by examiner

*Primary Examiner*—Mark F Huff
*Assistant Examiner*—Rachel L Burney
(74) *Attorney, Agent, or Firm*—Oblon, Spivak, McClelland, Maier & Neustadt, L.L.P.

(57) ABSTRACT

A method of forming fixed images, including the step of applying a two-component developer containing a carrier and a toner containing a wax and a resin binder containing a crystalline polyester to a two-component development device with a linear speed of from 500 to 5,000 mm/sec, to develop the toner, wherein the crystalline polyester is contained in an amount of from 3 to 40% by weight and the wax in an amount of from 2.5 to 10% by weight, of the toner, and wherein the two-component development device comprises at least three magnet rollers which are arranged closely to each other along the perimeter of a photoconductor, wherein one magnet roller arranged on the uppermost side in the rotational direction of the photoconductor rotates in a direction opposite to the rotational direction of the photoconductor at the point therebetween, and the other magnet rollers rotate in the same direction as the photoconductor at the point therebetween. The method of forming fixed images according to the present invention forms excellent fixed images by, for example, development of a latent image formed in electrophotography, electrostatic recording method, electrostatic printing method, or the like.

17 Claims, No Drawings

METHOD OF FORMING FIXED IMAGES

FIELD OF THE INVENTION

The present invention relates to a method of forming fixed images using a toner used for, for example, development of a latent image formed in electrophotography, electrostatic recording method, electrostatic printing method, or the like.

BACKGROUND OF THE INVENTION

As a resin binder for toners, an amorphous polyester has been conventionally frequently used, from the viewpoint of fixing ability and durability. However, development of a toner having even more improved fixing ability and durability has been required. Accordingly, in addition to the amorphous polyester, there has been proposed a toner containing a crystalline polyester itself having a releasing effect as a resin binder, from the viewpoint of improving fixing ability (see JP2001-222138 A and JP2004-61875 A).

On the other hand, with the increasing demands for on-demand printing, there has been required a toner and a developer which can meet the requirements of both high-quality image and high speed. To cope with deterioration of the developer due to the high speed, specifically, fusion of the toner to the surface of a carrier (scum formation), it has been tried to lower the surface energy of the carrier by coating the surface of the carrier with a resin (see JP-A-Showa-55-127569).

SUMMARY OF THE INVENTION

The present invention relates to a method of forming fixed images, including the step of applying a two-component developer containing a carrier and a toner containing a wax and a resin binder containing a crystalline polyester to a two-component development device with a linear speed of from 500 to 5,000 mm/sec, to develop the toner, wherein the crystalline polyester is contained in an amount of from 3 to 40% by weight and the wax in an amount of from 2.5 to 10% by weight, of the toner, and wherein the two-component development device comprises at least three magnet rollers which are arranged closely to each other along the perimeter of a photoconductor, wherein one magnet roller arranged on the uppermost side in the rotational direction of the photoconductor rotates in a direction opposite to the rotational direction of the photoconductor at the point therebetween, and the other magnet rollers rotate in the same direction as the photoconductor at the point therebetween.

DETAILED DESCRIPTION OF THE INVENTION

The present invention relates to a method of forming fixed images, capable of continuously obtaining high-quality fixed images without lowering its image quality, even when a toner containing a crystalline polyester as a resin binder is used in a high-speed development device.

According to the present invention, even when a toner containing a crystalline polyester as a resin binder is used in a high-speed development device, a high quality image can be continuously obtained without lowering its image quality.

These and other advantages of the present invention will be apparent from the following description.

When a developer containing a toner containing a conventional crystalline polyester and a resin-coated carrier is applied to a high-speed development device having a linear speed of 500 mm/sec or more, lowering of the image density or an edge effect becomes remarkable due to rise in triboelectric charges, thereby generating the deterioration of fixed images.

As a result of studies on the application of a toner containing a crystalline polyester in a high-speed development device, the present inventors have surprisingly found that when the fusion of the toner to the surface of the carrier, which has conventionally been considered to be suppressed, is appropriately accelerated using a toner containing a wax in a relatively large amount, the deterioration of the fixed images in the continuous printing with the high-speed development device can be suppressed.

One of the features of the toner used in the method of the present invention resides in that the toner contains a crystalline polyester as a resin binder, and a wax in a specified amount. Generally, crystalline polyester has a low dispersibility in the toner, which greatly affects the triboelectric chargeability of the toner, and especially triboelectric stability during the continuous printing. This is because when the crystalline polyester is localized, the triboelectric charges are also localized to the localized portion, whereby the triboelectric charges are less likely to leak. Therefore, when the triboelectric charge rises during the continuous printing, lowering of the image density and consequent worsening of image quality take place. In a high-speed development device comprising plural magnet rollers, since a stress applied to the developer is large and further a processing speed is high, the triboelectric charges of the toner containing a crystalline polyester are remarkably increased, thereby making it more likely to cause deterioration in image quality.

However, in the present invention, when a toner containing a crystalline polyester and a wax in a specified amount is applied to a high-speed two-component development device comprising at least three magnet rollers, an elevation in the triboelectric charges accompanying the high-speed continuous printing can be suppressed, so that stable printed images can be obtained. Although not wanting to be limited by theory, this is presumably due to the fact while being subjected to repeated triboelectric charging, since the toner contains the crystalline polyester and the wax in a specified amount, the toner appropriately fuses to the carrier which donates an electrical charge to the toner, whereby consequently the rise in the triboelectric charges is suppressed. Since the fusion of the toner to the surface of the carrier (hereinafter also referred to as scum formation) deteriorates the charge-donating ability of the carrier, the prevention of the scum formation has been conventionally necessitated as much as possible. However, contrary to the conventional technological common knowledge, in the present invention, stable triboelectric charges can be maintained by suitably inducing the scum formation, which in turn can maintain an excellent stability in image quality.

As described above, the toner used in the present invention contains a resin binder containing a crystalline polyester, and a wax in a specified amount.

In the present invention, the term "crystalline" means that a ratio of a softening point to a maximum peak temperature of heat of fusion (softening point/peak temperature) is from 0.6 to 1.3, preferably from 0.9 to 1.2, and more preferably more than 1 and 1.2 or less, and the term "amorphous" means that a ratio of a softening point to a maximum peak temperature of heat of fusion (softening point/peak temperature) of more than 1.3 and 4 or less, and preferably from 1.5 to 3.

As for molecular weights of the crystalline polyester, from the viewpoint of causing a suitable scum formation for the purpose of maintaining triboelectric stability, the crystalline polyester resin has a number-average molecular weight of preferably from 3,000 to 10,000, more preferably from 4,000 to 9,000, and even more preferably from 5,000 to 8,000, and the crystalline polyester resin has a weight-average molecular weight of preferably from 15,000 to 8,000,000, more preferably from 50,000 to 8,000,000, and even more preferably from 70,000 to 6,000,000.

The crystalline polyester has a softening point of preferably from 95° to 140° C., and more preferably from 100° to 135° C., from the viewpoint of fixing ability.

In the present invention, the crystalline polyester is preferably a resin obtained by polycondensing an alcohol component containing 80% by mole or more of an aliphatic diol having 2 to 6 carbon atoms, and preferably 4 to 6 carbon atoms, and a carboxylic acid component containing 80% by mole or more of an aliphatic dicarboxylic acid compound having 2 to 8 carbon atoms, preferably 4 to 6 carbon atoms, and more preferably 4 carbon atoms.

The aliphatic diol having 2 to 6 carbon atoms includes ethylene glycol, 1,2-propylene glycol, 1,3-propylene glycol, 1,4-butanediol, 1,5-pentanediol, 1,6-hexanediol, neopentyl glycol, 1,4-butenediol, and the like. More preferable are αω-linear alkanediols.

It is desired that the aliphatic diol having 2 to 6 carbon atoms is contained in the alcohol component in an amount of 80% by mole or more, and preferably from 90 to 100% by mole. It is desired that one kind of the aliphatic diols occupies 70% by mole or more, and preferably from 80 to 95% by mole, of the alcohol component. Among them, it is desired that 1,4-butanediol is contained in the alcohol component in an amount of preferably 60% by mole or more, more preferably from 70 to 100% by mole, and even more preferably from 80 to 100% by mole.

The alcohol component may contain a polyalcohol component other than the aliphatic diol having 2 to 6 carbon atoms. The polyalcohol component includes aromatic diols such as an alkylene (2 to 3 carbon atoms) oxide (average number of moles: 1 to 10) adduct of bisphenol A, such as polyoxypropylene(2.2)-2,2-bis(4-hydroxyphenyl)propane, polyoxyethylene(2.0)-2,2-bis(4-hydroxyphenyl)propane and polyoxyethylene(2.2)-2,2-bis(4-hydroxyphenyl)propane; trihydric or higher polyhydric alcohols such as glycerol, pentaerythritol, and trimethylolpropane; and the like.

The aliphatic dicarboxylic acid compound having 2 to 8 carbon atoms includes oxalic acid, malonic acid, maleic acid, fumaric acid, citraconic acid, itaconic acid, glutaconic acid, succinic acid, and adipic acid; anhydrides thereof; alkyl (1 to 3 carbon atoms) esters thereof; and the like. Among them, fumaric acid and adipic acid are preferable, and fumaric acid is more preferable. The aliphatic dicarboxylic acid compound refers to aliphatic dicarboxylic acids, acid anhydrides thereof, and alkyl (1 to 3 carbon atoms) esters thereof, as described above. Among them, the aliphatic dicarboxylic acids are preferable.

It is desired that the aliphatic dicarboxylic acid compound having 2 to 8 carbon atoms is contained in the carboxylic acid component in an amount of 80% by mole or more, and preferably from 90 to 100% by mole. It is desired that one kind of the aliphatic dicarboxylic acid compounds occupies 60% by mole or more, preferably from 70 to 100% by mole, and more preferably from 80 to 100% by mole of the carboxylic acid component. Among them, it is desired that fumaric acid is contained in the carboxylic acid component in an amount of preferably 60% by mole or more, more preferably from 70 to 100% by mole, and even more preferably from 80 to 100% by mole.

The carboxylic acid component may contain a polycarboxylic acid component other than the aliphatic dicarboxylic acid compound having 2 to 8 carbon atoms. The polycarboxylic acid component includes aromatic dicarboxylic acids such as phthalic acid, isophthalic acid, and terephthalic acid; aliphatic dicarboxylic acids such as sebacic acid, azelaic acid, n-dodecylsuccinic acid, and n-dodecenylsuccinic acid; alicyclic dicarboxylic acids such as cyclohexanedicarboxylic acid; tricarboxylic or higher polycarboxylic acids such as trimellitic acid and pyromellitic acid; acid anhydrides thereof; alkyl (1 to 3 carbon atoms) esters thereof; and the like.

As for the molar ratio of the carboxylic acid component to the alcohol component (carboxylic acid component/alcohol component) in the crystalline polyester, it is preferable that the crystalline polyester contains a larger amount of the alcohol component than the carboxylic acid component, from the viewpoint of obtaining a crystalline polyester having the average molecular weight defined above. Further, the molar ratio is preferably 0.9 or more and less than 1, and more preferably 0.95 or more and less than 1, from the viewpoint that the molecular weight of the polyester can be easily adjusted by distilling off the alcohol component during vacuum reaction.

The polycondensation of the alcohol component and the carboxylic acid component can be carried out by reacting the components in an inert gas atmosphere at a temperature of 120° to 230° C. in the presence of an esterification catalyst, a polymerization inhibitor, and the like as desired, or the like. Specifically, in order to enhance the strength of the resin, an entire monomer may be charged at once. Alternatively, in order to reduce the low-molecular weight components, divalent monomers may be firstly reacted, and thereafter trivalent or higher polyvalent monomers are added and reacted. In addition, the reaction may be accelerated by reducing a pressure of the reaction system in the latter step of the polymerization.

The crystalline polyester is contained in an amount of from 3 to 40% by weight, preferably from 4 to 35% by weight, and more preferably from 5 to 30% by weight, of the toner, from the viewpoint of fixing ability and offset resistance.

The resin binder used together with the crystalline polyester in the present invention includes a known resin to be used in a toner, for example, an amorphous polyester, a styrene-acrylic resin, an epoxy resin, a polycarbonate, a polyurethane, and the like. Among them, the amorphous resin and the styrene-acrylic resin copolymer are preferable, and from the viewpoint of dispersibility, fixing ability, and durability of the wax, the amorphous polyester is more preferable.

The amorphous polyester can also be prepared by polycondensing an alcohol component and an carboxylic acid component in the same manner as the crystalline polyester. Here, in order to prepare an amorphous polyester, it is preferable that the following requirements are met:

(1) in a case where monomers for enhancement of crystallization of a resin, such as an aliphatic diol having 2 to 6 carbon atoms and an aliphatic dicarboxylic compound having 2 to 8 carbon atoms, are used, a resin in which crystallization is suppressed by using two or more of these monomers in combination, in each of the alcohol component and the carboxylic acid component, one of these monomers is used in an amount of from 10 to 70% by mole, preferably 20 to 60% by mole of each component, and these monomers are used in two or more kinds, preferably two to four kinds; or (2) a resin obtained from monomers for enhancement of amorphousness of a resin, preferably an alkylene oxide adduct of bisphenol A as an alcohol component, or an aromatic carboxylic acid or a substituted succinic acid of which substituent is an alkyl group or alkenyl group as a carboxylic acid component are used in an amount of from 30 to 100% by mole, preferably from 50 to 100% by mole, of the alcohol component or the carboxylic acid component, preferably of the alcohol component and the carboxylic acid component, respectively.

When used as a positively chargeable toner, the amorphous polyester has an acid value of preferably 15 mg KOH/g or less, and more preferably 12 mg KOH/g or less.

The amorphous polyester has a softening point of preferably from 70° to 180° C., and more preferably from 100° to 160° C.; and a glass transition temperature of preferably from 45° to 80° C., and more preferably from 55° to 75° C. Here, the glass transition temperature is a property inherently owned by the amorphous resin and distinguished from the maximum peak temperature of heat of fusion.

The amorphous polyester has a number-average molecular weight of preferably from 1,000 to 6,000, and more preferably from 2,000 to 5,000. In addition, the amorphous polyester has a weight-average molecular weight of preferably 10,000 or more, more preferably from 30,000 or more, and preferably 1,000,000 or less.

It is preferable that the amorphous polyester comprises two kinds of amorphous polyesters having a difference in softening point of 10° C. or more. From the viewpoint of low-temperature fixing ability and high-temperature offset resistance, it is preferable that a low-softening point polyester having a softening point of 70° C. or more and less than 120° C., and a high-softening point polyester having a softening point of 120° C. or more and 180° C. or less, are used together in a weight ratio (low-softening point polyester/high-softening point polyester) of preferably from 20/80 to 80/20.

The weight ratio of the crystalline polyester to the amorphous polyester (crystalline polyester/amorphous polyester) is preferably from 3/97 to 45/55, more preferably 4/96 to 40/60, and even more preferably from 5/95 to 35/65, from the viewpoint of fixing ability, triboelectric stability, and filming resistance.

The toner of the present invention may appropriately contain as resin binders a crystalline resin and an amorphous resin other than the crystalline polyester and the amorphous polyester as occasion demands. When used for positively chargeable toners, these resins have an acid value of preferably 15 mg KOH/g or less, and more preferably 12 mg KOH/g or less.

The toner of the present invention contains a wax in a specified amount. Usually, as the content of the wax increases, fixing ability is improved, but on the other hand, filming or scum formation is likely to be caused. In the present invention, however, it is clarified that the scum formation is effective in suppressing the rise in the triboelectric charges. From these viewpoints, the wax is contained in the toner of the present invention in an amount of from 2.5 to 10% by weight, preferably from 2.7 to 8% by weight, and more preferably from 2.7 to 7.5% by weight.

The wax includes aliphatic hydrocarbon-based waxes such as polypropylene wax, polyethylene wax, polypropylene-polyethylene copolymer wax, microcrystalline wax, paraffin wax, and Fischer-Tropsch wax, and oxides thereof; ester waxes such as carnauba wax, montan wax, candelilla wax, rice wax, and Sazole wax, and deoxidized waxes thereof; fatty acid amides; fatty acids; higher alcohols; metal salts of fatty acids; and the like. Among them, low-molecular molecular weight polypropylenes, the ester waxes, and the fatty acid amides are preferable, and the ester waxes are more preferable. The ester wax has a melting point of preferably from 60° to 100° C., and more preferably from 70° to 90° C., from the viewpoint of fixing ability.

In addition, from the viewpoint of triboelectric stability, it is preferable that two or more kinds of waxes having a difference in melting point of 20° C. or more are combined, and it is more preferable that the polypropylene wax having a melting point of from 100° to 160° C., and preferably from 110° to 150° C. is used together with the ester wax having a melting point of from 60° to 100° C., and preferably from 70° to 100° C. In this case, the weight ratio of the polypropylene wax to the ester wax (polypropylene wax/ester wax) is preferably 0.4 to 2.5, and more preferably from 0.5 to 2.1. The ester wax is preferably at least one member selected from the group consisting of carnauba wax, montan wax, candelilla wax, and rice wax; and more preferably carnauba wax, from the viewpoint of compatibility with the resins.

Further, the toner of the present invention may appropriately contain an additive such as a colorant, a charge control agent, an electric conductivity modifier, an extender, a reinforcing filler such as a fibrous substance, an antioxidant, an anti-aging agent, a fluidity improver, or a cleanability improver.

As the colorant, all of the dyes, pigments, and the like which are used as colorants for toners can be used, and the colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These colorants can be used alone or in admixture of two or more kinds. The toner used in the present invention may be any of black toner, color toner, and full-color toner. The colorant is contained in an amount of preferably from 1 to 40 parts by weight, and more preferably from 3 to 10 parts by weight, based on 100 parts by weight of the resin binder.

As a charge control agent, a known charge control agent can be used. The charge control agent includes, for example, chromium-azo complex dyes; iron-azo complex dyes; cobalt-azo complex dyes; metal compounds of salicylic acid or a derivative thereof; chromium, zinc, aluminum, and boron complexes or salt compounds of naphthoic acid or a derivative thereof; chromium, zinc, aluminum, and boron complexes or salt compounds of benzilic acid or a derivative thereof; surfactants such as long-chain alkyl carboxylates and long-chain alkyl sulfonates, a nigrosine dye and a derivative thereof, triphenylmethane derivatives, derivatives of quaternary ammonium salt, quaternary phosphonium salt, quaternary pyridinium salt, guanidine salt, amidine salt, and the like; and the like.

In the case of a positively chargeable toner, among these charge control agents, the quatemary ammonium salt and/or the nigrosine dye is preferable, from the viewpoint of triboelectric chargeability (level of triboelectric charges, charging speed), in other words, a balance between the rise in the triboelectric charges due to the continuous printing and the suppression of the triboelectric charges due to the fusion of the toner to a charge-donating material or the like.

It is preferable that the quaternary ammonium salt is a compound represented by the formula (I):

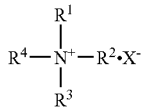

(I)

wherein each of $R^1$ to $R^4$, which may be identical or different, is a lower alkyl group having 1 to 8 carbon atoms which may be substituted by a halogen atom, an alkyl group or an alkenyl group having 8 to 22 carbon atoms, or an aryl group having 6 to 20 carbon atoms or an aralkyl group having 7 to 20 carbon atoms; and $X^-$ is an anion.

In the present invention, from the viewpoint of giving a toner with more stable triboelectric chargeability and more improved fixing ability, it is preferable that each of $R^1$ to $R^4$ is preferably a lower alkyl group having 1 to 4 carbon atoms which may be substituted by a halogen atom, an alkyl group having 12 to 18 carbon atoms, a phenyl group or a benzyl group; and that $X^-$ is an aromatic sulfonate ion such as toluenesulfonate ion or hydroxynaphthalenesulfonate ion; an aromatic carboxylate ion; molybdate: ion; tungstate ion; a halogen ion or a hydroxide ion, and more preferably the aromatic sulfonate ion, the aromatic carboxylate ion, and the molybdate ion.

The commercially available product containing the compound represented by the formula (I) includes "TP-415" (commercially available from Hodogaya Chemical Co., Ltd.), "BONTRON P-51" (commercially available from Orient Chemical Co., Ltd.), "COPY CHARGE PSY" (commercially available from Clariant (Japan) K.K.), and the like.

Among the compounds represented by the formula (I), in the present invention, a compound represented by the formula (Ia):

(Ia)

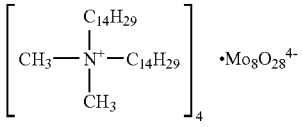

is preferable. Among the commercially available products mentioned above, "COPY CHARGE PSY" (commercially available from Clariant (Japan) K.K.) corresponds to the one containing the compound defined above.

The quaternary ammonium salt is contained in an amount of preferably from 0.01 to 5 parts by weight, more preferably from 0.05 to 3 parts by weight, and even more preferably from 0.1 to 2 parts by weight, based on 100 parts by weight of the resin binder.

The nigrosine dye is a black mixture of multi-components generally obtained by polycondensation of nitrobenzene with aniline in the presence of a metal catalyst. Although its structure has not been sufficiently elucidated, the commercially available nigrosine dyes, including the products modified by a resin acid, include, "Nigrosine Base EX," "Oil Black BS," "Oil Black SO," "BONTRON N-01," "BONTRON N-04," "BONTRON N-07," "BONTRON N-09," "BONTRON N-11," "BONTRON N-21" (hereinabove commercially available from Orient Chemical Co., Ltd.); "Nigrosine" (commercially available from Ikeda Kagaku Kogyo); "Spirit Black No. 850," "Spirit Black No. 900" (hereinabove commercially available from Sumitomo Chemical Company Limited); and the like. When the nigrosine dye is used together with a polyester as a resin binder, a nigrosine dye modified by a resin acid is preferable from the viewpoint of dispersibility. Among the above-mentioned products, the commercially available product of the modified nigrosine dye includes "BONTRON N-01," "BONTRON N-04," "BONTRON N-21" (hereinabove commercially available from Orient Chemical Co., Ltd.), and the like.

The nigrosine dye is contained in an amount of preferably from 0.2 to 5 parts by weight, and more preferably from 0.5 to 4 parts by weight, based on 100 parts by weight of the resin binder. In addition, the weight ratio of the quaternary ammonium salt to the nigrosine dye is preferably from 1/100 to 100/100, and more preferably from 10/100 to 70/100.

The toner used in the present invention may be obtained by any of the conventionally known methods such as a kneading-pulverization method, an emulsion phase-inversion method, and a polymerization method. A pulverized toner obtained by the kneading-pulverization method is preferable because a toner containing a crystalline polyester is easily prepared, and the effects of the present invention are remarkably exhibited. In a case of obtaining a toner by the kneading-pulverization method, the toner can be prepared by homogeneously mixing a resin binder, a wax, a colorant, a charge control agent, and the like in a mixer such as a Henschel mixer, thereafter melt-kneading with a closed kneader, a single-screw or twin-screw extruder or the like, cooling, pulverizing and classifying the product. Further, a fluidity improver or the like such as a hydrophobic silica may be added to the surface of the toner as occasion demands. The toner has a volume-median particle size ($D_{50}$) of preferably from 3 to 15 μm. In the present invention, the volume-median particle size ($D_{50}$) means a particle size corresponding to a 50% cumulative volume frequency calculated by the volume fraction of the toner, counting from the side of smaller particle size.

The carrier used in the present invention is preferably one having a low saturation magnetization, which forms a soft magnetic brush, from the viewpoint of the properties of fixed images. When a magnetic field of 79.6 kA/m (1 Oe) is applied, the carrier has a saturation magnetization of preferably from 40 to 100 $Am^2/kg$, and more preferably from 50 to 90 $Am^2/kg$, from the viewpoint of tone reproducibility, and prevention of carrier adhesion and toner scattering.

As a core material for the carrier, any known core materials can be used without particular limitation. The core material includes, for example, ferromagnetic metals such as iron, cobalt and nickel; alloys and compounds such as magnetite, hematite, ferrite, copper-zinc-magnesium-based ferrite, magnesium-based ferrite, and manganese-based ferrite; glass beads; and the like. Among them, the carrier made of magnesium-based ferrite is preferable.

It is preferable that the surface of the carrier is coated with a resin, from the viewpoint of triboelectric chargeability and the like. As the resin for coating the surface of the carrier, the resin containing an acrylic resin is preferable, from the viewpoint of controlling the amount of scum accompanying the rise in the triboelectric charges.

The two-component developer used in the present invention can be obtained by mixing a toner and a carrier with a mixer such as a Henschel mixer. The weight ratio of the toner to the carrier in the two-component developer (toner/carrier) is preferably from 0.5/100 to 8/100, and more preferably from 1/100 to 6/100.

The two-component development device used in the present invention is a high-speed device having a linear speed of from 500 to 5,000 mm/sec, and preferably from 700 to 5,000 mm/sec, comprising at least three magnet rollers which are arranged closely to each other along the perimeter of a photoconductor, wherein one magnet roller arranged on the uppermost side in the rotational direction of the photoconductor rotates in a direction opposite to the rotational direction of the photoconductor at the point therebetween, and the other magnet rollers rotate in the same direction as the photoconductor at the point therebetween. Here, the same direction means that the moving directions at the point between the photoconductor and the magnet roller are the same. A larger stress is applied to a developer in high-speed development devices than that in low-speed development devices, so that a disadvantage of scum formation is more likely to take place in the high-speed development devices. The phenomenon of scum formation markedly takes place in a development device comprising plural magnet rollers for conveying toners. In the present invention, as described above, the development device comprises at least three magnet rollers which are arranged closely to each other along the perimeter of a photoconductor, wherein one magnet roller arranged on the uppermost side in the rotational direction of the photoconductor rotates in a direction opposite to the rotational direction of the photoconductor at the point therebetween, and the other magnet rollers rotate in the same direction as the photoconductor at the point therebetween. Therefore, it is believed that a large stress is applied to the developer. Since a two-component developer containing a specified toner is used so that scum formation, which is conventionally thought to be suppressed, is appropriately accelerated, whereby an excellent image quality can be maintained even when subjected to the high-speed continuous printing.

In the present invention, the linear speed refers to a processing speed of a printing device, and is determined by sheet feeding speed in the fixing portion.

The gap between the photoconductor and the magnet roller is not particularly limited because it varies depending upon the size of the device or the like. The gap is preferably from 1.0 to 1.5 mm.

Concrete examples of the two-component development device comprising a photoconductor and three magnet rollers include a device disclosed in FIG. 1 of JP-A-Hei-8-286503.

One of the features of the method of forming fixed images the present invention resides in that scum formation is caused in the developing step, different from conventional methods. The amount of scum (amount of the toner fused to the surface of the carrier) varies depending upon the structure of the device, printing ratio, or the like. It is preferable that the toner used in the present invention has an amount of scum according to a standard test of preferably from 0.035 to 0.20%, and more preferably from 0.050 to 0.19%. The amount of scum formation can be increased by a method including the step of, for example, using a crystalline polyester or wax having a lower melting point, increasing the content of the crystalline polyester or the wax, lowering dispersibility of the crystalline polyester or wax in the toner, or the like.

Here, the standard test refers to the following method in which a two-component contact development type high-speed continuous feeding sheet printer "Infoprint 4000ISI" (commercially available from IBM Japan, Ltd., linear speed: 1066 mm/sec, resolution: 240 dpi, development system: 3 magnet rollers, selenium photoconductor, reversal development) is used as a testing instrument.

[Standard Test]

(1) The power to the above-mentioned printer "Infoprint 4000ISI" is turned on, and thereafter 3.5 kg of the developer obtained by mixing 39 parts by weight of the toner and 1261 parts by weight of the carrier (ferrite carrier or magnesium-based carrier, average particle size: 80 to 130 μm, saturation magnetization: 40 to 100 μm) with a mixer for 10 minutes, is loaded to the printer. Further, 2 bottles full (each containing 1.5 kg) of the toner are added thereto.

(2) About 5 g each of the developers is sampled from the center portion of each of the three magnet rollers for determination of the properties, all the sampled developers are placed in one plastic bottle A with a lid on, and the ingredients are mixed together.

(3) The contrast of the fixed images is fixed to 4, and a printing pattern having a blackened ratio of 8% is printed onto 150,000 sheets of HSP-G paper (11×18 inch) commercially available from IBM Japan, Ltd. Incidentally, the printing operation is carried out according to the "Operator's Manual" prepared by IBM Japan, Ltd.

(4) After the printing of 150,000 sheets, about 5 g each of the developers is again sampled from the center portion of each of the three magnet rollers for determination of the properties, all the sampled developers are placed in one plastic bottle B with a lid on, and the ingredients are mixed together.

(5) In the developers sampled in the plastic bottle A (before printing) and the plastic bottle B (after printing 150,000 sheets), the amounts of the toners fused to the surfaces of the carriers are individually converted to the content of the carbon (% by weight) measured with a carbon analyzer, and the difference in the obtained values is defined as the above-mentioned "amount of scum."

According to the method of forming fixed images, fixed images can be formed through known steps except that the method of the present invention has a feature in the developing step. Representative steps in the method include the steps of forming an electrostatic latent image on the surface of the photoconductor (charging and exposing step) before the developing step; transferring the developed toner image to an image-bearing material such as paper (transferring step) after the developing step; fixing the transferred toner image on the image-bearing material with heat, pressure, or the like (fixing step); removing the toner remaining in a developing member such as a photoconductive drum (cleaning step); and the like.

EXAMPLES

The following examples further describe and demonstrate embodiments of the present invention. The examples are given solely for the purposes of illustration and are not to be construed as limitations of the present invention.

[Softening Point]

The softening point refers to a temperature corresponding to h/2 of the height (h) of the S-shaped curve when plotting a downward movement of a plunger (flow length) against temperature, namely, a temperature at which a half of the resin flows out, when measured by using a flow tester (CAPILLARY RHEOMETER "CFT-500D," commercially available from Shimadzu Corporation), in which a 1 g sample is extruded through a nozzle having a die pore size of 1 mm and a length of 1 mm, while heating the sample so as to raise the temperature at a rate of 6° C./min and applying a load of 1.96 MPa thereto with the plunger.

[Maximum Peak Temperature of Heat of Fusion, Glass Transition Temperature, and Melting Point of Wax]

The maximum peak temperature of heat of fusion is determined using a differential scanning calorimeter (commercially available from Seiko Instruments, Inc., DSC 210), by raising its temperature to 200° C., cooling the heated sample from this temperature to 0° C. at a cooling rate of 10° C./min, and thereafter raising the temperature of the sample at a rate of 10° C./min. Incidentally, the maximum peak temperature in a wax is referred to as a melting point. In addition, the glass transition temperature refers to the temperature of an intersection of the extension of the baseline of equal to or lower than the maximum peak temperature and the tangential line showing the maximum inclination between the kick-off of the peak and the top of the peak by the determination mentioned above.

[Acid Value]

Determined according to JIS K0070.

[Average Molecular Weights of Resins]

The number-average molecular weight and the volume-average molecular weight are obtained from the molecular weight distribution determined by the gel permeation chromatography according to the following method.

(1) Preparation of Sample Solution

A crystalline polyester is dissolved in chloroform and an amorphous polyester is dissolved in tetrahydrofuran, so as to each have a concentration of 0.5 g/100 ml. Each of the resulting solution is then filtered with a fluororesin filter ("FP-200," commercially available from Sumitomo Electric Industries, Ltd.) having a pore size of 2 μm to remove insoluble components, to give a sample solution.

(2) Determination of Molecular Weight Distribution

As an eluant, chloroform when determining for a crystalline polyester, or tetrahydrofuran for an amorphous polyester is allowed to flow at a rate of 1 ml/min, and the column is stabilized in a thermostat at 40° C. One-hundred microliters of the sample solution is injected to the column to determine the molecular weight distribution. The molecular weight of the sample is calculated on the basis of a calibration curve previously prepared. The calibration curve of the molecular weight is one prepared by using several kinds of monodisperse polystyrenes as standard samples.

Analyzer: CO-8010 (commercially available from Tosoh Corporation)

Column: GMHLX+G3000HXL (commercially available from Tosoh Corporation)

[Volume-Median Particle Size ($D_{50}$) of Toners]

Measuring Apparatus: Coulter Multisizer II (commercially available from Beckman Coulter)

Aperture Diameter: 100 μm

Range of Particle Sizes to Be Determined: 2 to 60 μm

Analyzing Software: Coulter Multisizer AccuComp Ver. 1.19 (commercially available from Beckman Coulter)

Electrolytic Solution: Isotone II (commercially available from Beckman Coulter)

Dispersion: 5% electrolyte of EMULGEN 109P (commercially available from Kao Corporation, polyoxyethylene lauryl ether, HLB: 13.6)

Dispersing Conditions: Ten milligrams of a test sample is added to 5 ml of the dispersion, and the resulting mixture is dispersed in an ultrasonic disperser for 1 minute. Thereafter, 25 ml of the electrolyte is added to the dispersion, and the resulting mixture is dispersed in an ultrasonic disperser for another 1 minute.

Measurement Conditions: One-hundred milliliters of the electrolyte and the dispersion are added to a beaker, and the particle sizes of 30,000 particles are determined with a concentration satisfying that the particle sizes for 30,000 particles can be determined in 20 seconds, to obtain a volume-average particle size ($D_{50}$) from its particle size distribution.

[Saturation Magnetization]

(1) A sample is filled in a plastic case with a lid with tapping, the case having an outer diameter of 7 mm and a height of 5 mm. The mass of the sample is determined from the difference of the weight of the plastic case and the weight of the plastic case filled with the sample.

(2) The plastic case filled with the sample is set in a sample holder of a device for measuring magnetic property "BHV-50H" (V. S. MAGNETOMETER) commercially available from Riken Denshi Co., Ltd. The saturation magnetization is determined by applying a magnetic field of 79.6 kA/m, with vibrating the plastic case using the vibration function. The value obtained is calculated as the saturation magnetization per unit mass, taking into consideration the mass of the filled sample.

Preparation Example 1 of Crystalline Polyester

A 5-liter four-necked flask equipped with a nitrogen inlet tube, a dehydration tube, a stirrer, and a thermocouple was charged with the raw materials as shown in Table 1, and the ingredients were maintained at 140° C. for 4 hours. The ingredients in the flask were reacted while raising the temperature of the ingredients from 140° to 160° C. at a heating rate of 10° C./hour and then from 160° to 200° C. at a heating rate of 20° C./hour. Thereafter, the heated material was reacted at 200° C. and 8.3 kPa until the material reached a desired number-average molecular weight. Various property values of the resulting resins a to f are shown in Table 1.

Preparation Example 1 of Amorphous Polyester

A 5-liter four-necked flask equipped with a nitrogen inlet tube, a dehydration tube, a stirrer, and a thermocouple was charged with the raw materials as shown in Table 1, and the ingredients were reacted at 230° C. for 8 hours. Thereafter, the reaction mixture was subjected to vacuum reaction at 230° C. and 8.3 kPa until the temperature reached a specified softening point. Various property values of the resulting resin A are shown in Table 1.

Preparation Example 2 of Amorphous Polyester

A 5-liter four-necked flask equipped with a nitrogen inlet tube, a dehydration tube, a stirrer, and a thermocouple was charged with the raw materials other than fumaric acid as shown in Table 1, and the ingredients were reacted at 230° C. for 6 hours. Thereafter, the reaction mixture was cooled to 180° C., and fumaric acid was supplied thereto. The mixture was reacted for 4 hours while raising the temperature of the mixture from 180° C. to 210° C. at a heating rate of 10° C./hour, and thereafter subjected to vacuum reaction at 210° C. and 8.3 kPa until the temperature reached a specified softening point. Various property values of the resulting resin B are shown in Table 1.

TABLE 1

| | Crystalline Polyester | | | | | | Amorphous Polyester | |
|---|---|---|---|---|---|---|---|---|
| | Resin a | Resin b | Resin c | Resin d | Resin e | Resin f | Resin A | Resin B |
| Stearic Acid | — | 64.5 g | — | 3780 g | 516 g | — | — | — |
| 1,6-Hexanediol | 6018 g | 5900 g | 1770 g | 1180 g | 1770 g | 5900 g | — | — |
| 1,4-Butanediol | — | — | 3150 g | — | 3150 g | | — | — |

TABLE 1-continued

| | Crystalline Polyester | | | | | | Amorphous Polyester | |
|---|---|---|---|---|---|---|---|---|
| | Resin a | Resin b | Resin c | Resin d | Resin e | Resin f | Resin A | Resin B |
| BPA-PO[1)] | — | — | — | — | — | — | 2450 g | 3087 g |
| BPA-EO[2)] | — | — | — | — | — | — | 975 g | 59 g |
| Fumaric Acid | 5800 g | 5800 g | 5800 g | 5916 g | 5984 g | 5800 g | — | 298 g |
| Trimellitic Anhydride | — | — | — | — | — | — | 278 g | 33 g |
| Dodecenylsuccinic Anhydride | — | — | | | — | — | 259 g | — |
| Terephthalic Acid | — | — | — | — | — | — | 961 g | 994 g |
| Hydroquinone | — | — | — | — | — | — | — | 4.5 g |
| Dibutyltin Oxide | — | — | — | — | — | — | 9.8 g | 8.9 g |
| Maximum Peak Temperature (° C.) of Heat of Fusion | 114.1 | 113.9 | 105.8 | 96.8 | 104.2 | 113.2 | 68.1 | 66.3 |
| Softening Point (° C.) | 118.6 | 118.6 | 112.9 | 103.6 | 97.7 | 110.3 | 145.0 | 104.3 |
| Glass Transition Temperature (° C.) | — | — | — | — | — | — | 63.2 | 59.2 |
| Acid Value (mg KOH/g) | — | — | — | — | — | — | 6.4 | 10.5 |
| Number-Average Molecular Weight | 6485 | 7151 | 4573 | 2942 | 3805 | 4271 | 3200 | 2100 |
| Weight-Average Molecular Weight | 3,378,070 | 87,778 | 71,944 | 16,453 | 19,492 | 15,473 | 160,000 | 12,400 |

[1)]Polyoxypropylene(2.2)-2,2-bis(4-hydroxyphenyl)propane
[2)]Polyoxyethylene(2.0)-2,2-bis(4-hydroxyphenyl)propane

Preparation Example of Toner

A resin binder, a charge control agent, and a wax as shown in Table 2, and 6.3 parts by weight of a carbon black "R330R" (commercially available from Cabot Corporation) were premixed with a Henschel mixer. Thereafter, the mixture was melt-kneaded with a twin-screw extruder, cooled, and thereafter subjected to usual pulverization step and classification step, to give a powder having a volume-average particle size (volume-median particle size ($D_{50}$)) of 10.0 μm. To 100 parts by weight of the resulting powder were added 0.3 parts by weight of a hydrophobic silica "HDK 2150" (commercially available from Clariant (Japan) K.K.) as an external additive. The ingredients were mixed with a Henschel mixer, to give a toner.

Preparation Example 1 of Carrier

Magnesium oxide was formulated in hematite so that magnesium was contained in an amount of 3.0% by weight. To 100 parts by weight of the mixture was added 1.5 parts by weight of a binder (polyvinyl alcohol), and water was added thereto so as to have a concentration of the slurry of 50% by weight. The resulting mixture was pulverized and mixed with an attritor (commercially available from MITSUI MINING COMPANY LTD.) in a wet process for 1 hour, to give a slurry.

The slurry was granulated and dried with a spray dryer. Next, the dried granules were baked in an electric furnace at about 1500° C. in a nitrogen atmosphere, and classified with a vibration sieve, to give a magnesium-based ferrite carrier represented by $MgO \cdot Fe_2O_3 \cdot Fe_3O_4$ as a core material for carriers.

Methyl ethyl ketone was added to 6.5 parts by weight of a fluororesin "HYLAR 301F"(commercially available from Ausmond) and 3.5 parts by weight of an acrylic resin "Dianal BR-80" (commercially available from Mitsubishi Rayon Co., Ltd.), based on 1,000 parts by weight of the resulting core material, to prepare a resin solution for coating the core material. The resin solution was spray-coated on the above-mentioned core material using a fluidized-coating device. Thereafter, a heat treatment was carried out at 100° C. for 60 minutes in the fluidized bed, to give a carrier A having an average particle size of 110 μm. The saturation magnetization of the carrier A was 70 $Am^2/kg$.

Preparation Example 2 of Carrier

The same procedures as in Preparation Example 1 of Carrier were carried out except that the acrylic resin was not used and the amount of the fluororesin was changed to 10 parts by weight, to give a carrier B having an average particle size of 110 μm and a saturation magnetization of 70 $Am^2/kg$.

Preparation Example 3 of Carrier

The core material was coated with the fluororesin and the acrylic resin in the same manner as in Preparation Example 1 of Carrier except that a commercially available Cu—Zn-based ferrite carrier was used as the core material, to give a carrier C having an average particle size of 110 μm and a saturation magnetization of 72 $Am^2/kg$.

Preparation Example 4 of Carrier

The core material was coated with the fluororesin and the acrylic resin in the same manner as in Preparation Example 1 of Carrier except that a commercially available magnetite-based ferrite carrier was used as the core material, to give a carrier D having an average particle size of 110 μm and a saturation magnetization of 90 $Am^2/kg$.

Preparation Example of Two-Component Developer

Two-Component Developers for Examples 1 to 14 and 18, and Comparative Examples 1 to 6

Thirty-nine parts by weight of a toner and 1261 parts by weight of the carrier A (ferrite carrier coated with fluororesin and acrylic resin, average particle size: 110 μm, saturation magnetization: 70 $Am^2/kg$) were mixed with a Nauta Mixer for 10 minutes, to give a two-component developer.

Two-Component Developer for Example 15

Thirty-nine parts by weight of a toner and 1261 parts by weight of the carrier B (ferrite carrier coated only with fluororesin, average particle size: 110 μm, saturation magnetization: 70 $Am^2/kg$) were mixed with a Nauta Mixer for 10 minutes, to give a two-component developer.

Two-Component Developer for Example 16

Thirty-nine parts by weight of a toner and 1261 parts by weight of the carrier C (commercially available Cu—Zn-based ferrite carrier coated with fluororesin and acrylic resin, average particle size: 110 μm, saturation magnetization: 72 $Am^2/kg$) were mixed with a Nauta Mixer for 10 minutes, to give a two-component developer.

Two-Component Developer for Example 17

Thirty-nine parts by weight of a toner and 1261 parts by weight of the carrier D (commercially available magnetite-based ferrite carrier coated with fluororesin and acrylic resin, average particle size: 110 μm, saturation magnetization: 90 $Am^2/kg$) were mixed with a Nauta Mixer for 10 minutes, to give a two-component developer.

Examples 1 to 18. and Comparative Examples 1 to 6

The power to a two-component contact development type high-speed continuous feeding sheet printer "Infoprint 40001S1" (commercially available from IBM Japan, Ltd., linear speed: 1066 mm/sec, resolution: 240 dpi, development system: 3 magnet rollers, selenium photoconductor, reversal development) was turned on, and thereafter, 3.5 kg of a developer was loaded in the printer. Further, 2 bottles full (each containing 1.5 kg) of the toner were added thereto.

About 5 g each of the developers was sampled from the center portion of each of the three magnet rollers for determination of the properties, all the sampled developers were placed in one plastic bottle A with a lid on, and the ingredients were mixed together.

The contrast of the fixed images was fixed to 4, and a printing pattern having a blackened ratio of 8% was printed onto 150,000 sheets of HSP-G paper (11×18 inch) commercially available from IBM Japan, Ltd. Incidentally, the printing operation was carried out according to the "Operator's Manual" prepared by IBM Japan, Ltd.

TABLE 2

| | | Wax | | | | Charge Control Agent | | |
|---|---|---|---|---|---|---|---|---|
| | | | | Carnauba | | | | |
| | Resin Binder | NP-105 | NP055 | Wax C-1 | EB-wax | N-04 | PSY | Carrier |
| Ex. 1 | Resin A/Resin B/Resin a = 53.7/17.0/17.0 | 1.8 | 0.9 | 1.3 | — | 1.8 | 0.2 | A |
| Ex. 2 | Resin A/Resin B/Resin a = 53.7/29.1/6.0 | 0.7 | 0.9 | 1.3 | — | 1.8 | 0.2 | A |
| Ex. 3 | Resin A/Resin B/Resin a = 50.9/16.6/16.6 | 2.6 | 2.5 | 2.5 | — | 1.8 | 0.2 | A |
| Ex. 4 | Resin A/Resin B/Resin b = 53.6/17.5/17.5 | 0.9 | 0.9 | 1.3 | — | 1.8 | 0.2 | A |
| Ex. 5 | Resin A/Resin B/Resin a = 53.7/17.1/17.1 | 1.8 | 0.9 | 1.3 | — | 1.8 | — | A |
| Ex. 6 | Resin A/Resin B/Resin a = 54.2/17.6/17.6 | 1.8 | 0.9 | 1.4 | — | — | 0.2 | A |
| Ex. 7 | Resin A/Resin B/Resin a = 54.1/17.2/17.2 | 1.8 | — | 1.4 | — | 1.8 | 0.2 | A |
| Ex. 8 | Resin A/Resin B/Resin c = 53.6/17.5/17.5 | 0.9 | 0.9 | 1.3 | — | 1.8 | 0.2 | A |
| Ex. 9 | Resin A/Resin B/Resin d = 53.5/17.8/17.8 | 0.4 | 0.9 | 1.3 | — | 1.8 | 0.2 | A |
| Ex. 10 | Resin A/Resin B/Resin e = 53.6/17.5/17.5 | 0.9 | 0.9 | 1.3 | — | 1.8 | 0.2 | A |
| Ex. 11 | Resin A/Resin B/Resin f = 52.5/17.6/17.6 | — | 0.9 | 1.3 | 1.8 | 1.8 | 0.2 | A |
| Ex. 12 | Resin A/Resin B/Resin a = 52.8/16.6/16.6 | 1.7 | 0.9 | 1.3 | 1.8 | 1.8 | 0.2 | A |
| Ex. 13 | Resin A/Resin B/Resin f = 52.8/17.7/17.7 | — | — | 3.5 | — | 1.8 | 0.2 | A |
| Ex. 14 | Resin A/Resin f = 61.3/26.4 | 1.8 | 0.9 | 1.3 | — | 1.8 | 0.2 | A |
| Ex. 15 | Resin A/Resin B/Resin a = 52.7/17.5/17.5 | 1.8 | 0.9 | 1.3 | — | 1.8 | 0.2 | B |
| Ex. 16 | Resin A/Resin B/Resin a = 52.7/17.5/17.5 | 1.8 | 0.9 | 1.3 | — | 1.8 | 0.2 | C |
| Ex. 17 | Resin A/Resin B/Resin a = 52.7/17.5/17.5 | 1.8 | 0.9 | 1.3 | — | 1.8 | 0.2 | D |
| Ex. 18 | Resin A/Resin B/Resin f = 52.8/17.7/17.7 | — | 3.5 | — | — | 1.8 | 0.2 | A |
| Comp. Ex. 1 | Resin A/Resin B/Resin a = 44.6/26.9/17.9 | — | 0.9 | 1.4 | — | 1.8 | 0.2 | A |
| Comp. Ex. 2 | Resin A/Resin B/Resin a = 26.7/44.8/17.9 | — | 0.9 | 1.4 | — | 1.8 | 0.2 | A |
| Comp. Ex. 3 | Resin A/Resin B/Resin a = 53.6/17.9/17.9 | — | 0.9 | 1.4 | — | 1.8 | 0.2 | A |
| Comp. Ex. 4 | Resin A/Resin B/Resin b = 54.2/17.6/17.6 | 0.9 | — | 1.4 | — | 1.8 | 0.2 | A |
| Comp. Ex. 5 | Resin A/Resin B/Resin c = 53.5/17.9/17.9 | 0.4 | 0.7 | 1.3 | — | 1.8 | 0.2 | A |
| Comp. Ex. 6 | Resin A/Resin B/Resin d = 49.1/16.0/16.0 | 4.1 | 4.1 | 2.5 | — | 1.8 | 0.2 | A |

Details of the waxes and the charge control agents listed in Table 2 are as follows:

NP-105: commercially available from MITSUI CHEMICALS, INC., polypropylene wax, melting point: 148° C.

NP055: commercially available from MITSUI CHEMICALS, INC., polypropylene wax, melting point: 142° C.

Carnauba Wax C-1: commercially available from Kato Yoko, melting point: 81° C.

EB-wax: commercially available from Kao Corporation, fatty acid amide, melting point: 142° C.

N-04: BONTRON N-04, commercially available from Orient Chemical Co., Ltd., Nigrosine dye PSY: COPY CHARGE PSY, commercially available from Clariant (Japan) K.K., quaternary ammonium salt After the printing of 150,000 sheets, about 5 g each of the developers was again sampled from the center portion of each of the three magnet rollers for determination of the properties, all the sampled developers were placed in one plastic bottle B with a lid on, and the ingredients were mixed together.

[Triboelectric Charges]

With the developers sampled in the plastic bottles A and B, the triboelectric charges of the toner before printing and those after printing 150,000 sheets were measured using a q/m meter (commercially available from Epping GmbH) under the following conditions, and the difference between the triboelectric charges ΔQ/M (triboelectric charges after printing of 150,000 sheets—triboelectric charges before printing) was calculated. The tolerable difference in the triboelectric charges (ΔQ/M) in this test is ±4.5 μC/g, from the viewpoint of stability of the printing quality. The results are shown in Table 3.

(Determination Conditions of Q/M Meter)

Sieve mesh size: 400 mesh (sieve opening: 38 μm, made of stainless steel, twilled, wire diameter: 0.0035 mm)

Blow pressure of soft blow: 1050 V

Aspiration time: 90 seconds

Triboelectric Charge (μC/g)=Total Triboelectric Charges After 90 Seconds (μC)/Amount of Toner Aspirated (g)

[Amount of Scum]

During the determination of the above-mentioned triboelectric charges, the content of carbon (% by weight) in the carrier remaining on the sieve mesh was measured with a carbon analyzer for solid samples "EMIA-110" (commercially available from HORIBA, Ltd., temperature of furnace: 1200° C., consumption of oxygen: 5 L/min, combustion improver: tin powder), and the difference between the contents (content of carbon in the carrier after printing 150,000 sheets (% by weight)—content of carbon in the carrier before printing (% by weight)) was calculated as the amount of scum accompanying the continuous printing. The results are shown in Table 3.

[Image Density]

The density of the fixed images (optical density) on the first sheet and that on the 150,000th sheet were determined with "GRETAG SPM50" (commercially available from Gretag-Macbeth AG), and the difference in image densities ΔOD (image density on the 150,000th sheet—image density on the first sheet) was calculated. Calibration was carried out with a white reference as "absolute white," using a calibration card "GretagMacbeth Density Calibration Reference" (Type: 47B/P, Density Standard: DIN 16536, Filter: Polarized). The permissible range of the difference between the image densities (ΔOD) in this test is ±0.45, from the viewpoint of stability of the printing quality. The results are shown in Table 3.

TABLE 3

| | Content of Wax (% by weight) | ΔQ/M | Amount of Scum | ΔOD |
|---|---|---|---|---|
| Ex. 1 | 4.0 | +0.2 | 0.113 | +0.02 |
| Ex. 2 | 2.9 | +2.3 | 0.079 | −0.15 |
| Ex. 3 | 7.6 | −0.2 | 0.150 | +0.08 |
| Ex. 4 | 3.1 | +1.6 | 0.098 | −0.07 |
| Ex. 5 | 4.0 | +1.9 | 0.095 | −0.08 |
| Ex. 6 | 4.1 | +1.8 | 0.096 | −0.09 |
| Ex. 7 | 3.2 | +0.3 | 0.101 | +0.02 |
| Ex. 8 | 3.1 | +2.2 | 0.075 | −0.15 |
| Ex. 9 | 2.6 | +4.1 | 0.050 | −0.33 |
| Ex. 10 | 3.1 | +2.7 | 0.055 | −0.17 |
| Ex. 11 | 4.0 | +1.9 | 0.088 | −0.07 |
| Ex. 12 | 5.7 | −0.1 | 0.129 | +0.03 |
| Ex. 13 | 3.5 | +1.7 | 0.108 | −0.09 |
| Ex. 14 | 4.0 | +1.9 | 0.100 | −0.14 |
| Ex. 15 | 4.0 | +4.4 | 0.037 | −0.44 |
| Ex. 16 | 4.0 | +4.4 | 0.039 | −0.41 |
| Ex. 17 | 4.0 | +4.5 | 0.039 | −0.45 |
| Ex. 18 | 3.5 | −1.1 | 0.189 | +0.15 |
| Comp. Ex. 1 | 2.3 | +7.4 | 0.029 | −0.79 |
| Comp. Ex. 2 | 2.3 | +8.7 | 0.022 | −0.77 |
| Comp. Ex. 3 | 2.3 | +5.8 | 0.031 | −0.69 |
| Comp. Ex. 4 | 2.3 | +6.6 | 0.029 | −0.82 |
| Comp. Ex. 5 | 2.4 | +7.1 | 0.034 | −0.89 |
| Comp. Ex. 6 | 10.6 | −9.8 | 0.205 | +0.52 |

It can be seen from the above results that favorable results are obtained in all the Examples. On the other hand, in Comparative Examples 1 to 5, since the amount of the wax is small, the amount of scum is lowered during the continuous printing, and lowering of the image density due to the rise in the triboelectric charge is noticeable. In addition, in Comparative Example 6, since the amount of wax is too large, the amount of scum during the continuous printing is exceedingly increased, so that a serious charge failure takes place, thereby giving an adverse effect to the fixed images.

According to the method of forming fixed images of the present invention, even more excellent fixed images are formed by, for example, development of a latent image formed in electrophotography, electrostatic recording method, electrostatic printing method, or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of forming fixed images, comprising applying a two-component developer comprising a carrier and a toner comprising a wax and a resin binder comprising a crystalline polyester to a two-component development device with a linear speed of from 500 to 5,000 mm/sec, to develop the toner, wherein the crystalline polyester is contained in an amount of from 3 to 40% by weight and the wax in an amount of from 2.5 to 10% by weight, of the toner, and wherein the two-component development device comprises at least three magnet rollers which are arranged closely to each other along the perimeter of a photoconductor, wherein one magnet roller arranged on the uppermost side in the rotational direction of the photoconductor rotates in a direction opposite to the rotational direction of the photoconductor at the point therebetween, and the other magnet rollers rotate in the same direction as the photoconductor at the point therebetween, wherein after printing 150,000 sheets, toner is fused to the surface of the carrier in an amount such that the difference in triboelectric charges (ΔQ/M) before printing and after printing said number of sheets is ± 4.5 μC/g, and wherein the carrier is a magnesium-based ferrite carrier coated with a resin comprising an acrylic resin and a fluororesin.

2. The method according to claim 1, wherein the crystalline polyester has a number-average molecular weight of from 3,000 to 10,000 and a weight-average molecular weight of from 15,000 to 8,000,000.

3. The method according to claim 1, wherein the resin binder further comprises an amorphous polyester, and the weight ratio of the crystalline polyester to the amorphous polyester is from 3/97 to 45/55.

4. The method according to claim 1, wherein the wax comprises an ester wax having a melting point of from 60° to 100° C.

5. The method according to claim 1, wherein the carrier has a saturation magnetization of from 40 to 100 $Am^2/kg$.

6. The method according to claim 1, wherein the crystalline polyester has a softening point of from 95° to 140° C.

7. The method according to claim 3, wherein the amorphous polyester has a softening point of from 70° to 180° C.

8. The method according to claim 4, wherein the wax further comprises a polypropylene wax having a melting point of from 100° to 160° C.

9. The method according to claim 1, wherein the crystalline polyester is contained in an amount of from 4 to 35% by weight of the toner.

10. The method according to claim 1, wherein the wax is contained in an amount of from 2.7 to 8% by weight of the toner.

11. The method according to claim 1, wherein the crystalline polyester has a number-average molecular weight of from 4,000 to 9,000 and a weight-average molecular weight of from 50,000 to 8,000,000.

12. The method according to claim 1, wherein the resin binder further comprises an amorphous polyester, and the weight ratio of the crystalline polyester to the amorphous polyester is from 4/96 to 40/60.

13. The method according to claim 1, wherein the wax comprises an ester wax having a melting point of from 70° to 90° C.

14. The method according to claim 1, wherein the carrier has a saturation magnetization of from 50 to 90 $Am^2/kg$.

15. The method according to claim 1, wherein the crystalline polyester has a softening point of from 100° to 135° C.

16. The method according to claim 3, wherein the amorphous polyester has a softening point of from 100° to 160° C.

17. The method according to claim 4, wherein the wax further comprises a polypropylene wax having a melting point of from 110° to 150° C.

* * * * *